US011428156B2

(12) United States Patent
Stanetsky

(10) Patent No.: US 11,428,156 B2
(45) Date of Patent: Aug. 30, 2022

(54) ROTARY VANE INTERNAL COMBUSTION ENGINE

(71) Applicant: Anatoli Stanetsky, Brooklyn, NY (US)

(72) Inventor: Anatoli Stanetsky, Brooklyn, NY (US)

( * ) Notice: Subject to any disclaimer, the term of this patent is extended or adjusted under 35 U.S.C. 154(b) by 0 days.

(21) Appl. No.: 17/489,703

(22) Filed: Sep. 29, 2021

(65) Prior Publication Data

US 2022/0018282 A1 Jan. 20, 2022

Related U.S. Application Data

(63) Continuation-in-part of application No. 16/894,775, filed on Jun. 6, 2020, now abandoned.

(51) Int. Cl.

| | |
|---|---|
| ***F02B 57/02*** | (2006.01) |
| ***F02B 57/06*** | (2006.01) |
| ***F01C 1/00*** | (2006.01) |
| ***F01C 1/02*** | (2006.01) |
| ***F01C 21/00*** | (2006.01) |

(Continued)

(52) U.S. Cl.

CPC ..... *F02B 57/02* (2013.01); *F01C 1/00* (2013.01); *F01C 1/02* (2013.01); *F01C 1/073* (2013.01); *F01C 1/12* (2013.01); *F01C 21/008* (2013.01); *F01C 21/06* (2013.01); *F02B 53/10* (2013.01); *F02B 55/02* (2013.01); *F02B 55/14* (2013.01); *F02B 57/06* (2013.01); *F04C 18/073* (2013.01)

(58) Field of Classification Search

CPC ..... F02B 57/02; F02B 57/06; F02B 53/00; F02B 53/10; F02B 55/02; F02B 55/14; F01C 1/00; F01C 1/02; F01C 1/073; F01C 1/12; F01C 21/008; F01C 21/06; F04C 18/073; Y02T 10/12

See application file for complete search history.

(56) References Cited

U.S. PATENT DOCUMENTS

| | | | |
|---|---|---|---|
| 1,302,143 | A | 4/1919 | Engel |
| 1,568,053 | A | 1/1926 | Bullington |

(Continued)

FOREIGN PATENT DOCUMENTS

| | | | |
|---|---|---|---|
| GB | 1460229 | A | 12/1976 |
| RU | 2054122 | C1 | 2/1996 |

(Continued)

*Primary Examiner* — Loren C Edwards

(74) *Attorney, Agent, or Firm* — Koffsky Schwalb LLC

(57) ABSTRACT

Rotary vane internal combustion engine comprises of two side-by-side rotors, placed in a cylindrical housing, wherein each rotor has at least two radial vanes rigidly attached to the rotor that form chambers for intake, compression, combustion, and exhaust. Each rotor alternately engages with a shaft by overrunning one-way clutches and is held from turning back, through the damper, mounted on a corresponding flywheel and forming a part of the flywheel assembly, which is rigidly attached on the shaft. The assembled rotors from the outside are rigidly closed by flanges on each of which is mounted at least one blade. The blades are positioned into formed cavities between the rotors and caps of the housing, thereby forming two cooling cavities through which coolant circulates around rotors through openings in the housing and through longitudinal grooves in the shaft. On the vanes are mounted cylindrical and conical seals, which remove the need for lubrication.

12 Claims, 12 Drawing Sheets

(51) Int. Cl.

| | |
|---|---|
| ***F01C 21/06*** | (2006.01) |
| ***F02B 53/10*** | (2006.01) |
| ***F02B 55/02*** | (2006.01) |
| ***F02B 55/14*** | (2006.01) |
| ***F01C 1/073*** | (2006.01) |
| ***F01C 1/12*** | (2006.01) |
| *F04C 18/073* | (2006.01) |

(56) References Cited

U.S. PATENT DOCUMENTS

| | | | | |
|---|---|---|---|---|
| 1,576,361 | A | | 3/1926 | Rogers |
| 1,712,945 | A | | 5/1929 | Thannhauser |
| 2,373,791 | A | | 4/1945 | Stewart |
| 2,398,864 | A | | 4/1946 | Le Roy |
| 2,400,286 | A | | 5/1946 | Buckbee |
| 2,638,880 | A | | 5/1953 | Mallinckrodt |
| 2,687,609 | A | | 8/1954 | Mallinckrodt |
| 2,913,198 | A | | 11/1959 | Bonbrake |
| 3,144,007 | A | | 8/1964 | Kauertz |
| 3,164,139 | A | | 1/1965 | Appleton |
| 3,181,509 | A | | 5/1965 | Simon |
| 3,186,383 | A | | 6/1965 | Cordingley |
| 3,228,183 | A | | 1/1966 | Fritz |
| 3,301,233 | A | | 1/1967 | Dotto |
| 3,437,079 | A | | 4/1969 | Odawara |
| 3,451,381 | A | | 6/1969 | Armstrong |
| 3,542,725 | A | | 11/1970 | Kopacki |
| 3,548,790 | A | | 12/1970 | Pitts |
| 3,565,049 | A | | 2/1971 | Bauer |
| 3,568,645 | A | | 3/1971 | Grimm |
| 3,572,030 | A | | 3/1971 | Cuff |
| 3,585,973 | A | | 6/1971 | Klover |
| 3,599,611 | A | | 8/1971 | Staat |
| 3,614,277 | A | | 10/1971 | Kobayashi |
| 3,744,938 | A | | 7/1973 | Matvey |
| 3,762,375 | A | | 10/1973 | Bentley |
| 3,769,946 | A | | 11/1973 | Scherrer |
| 3,782,110 | A | | 1/1974 | Kobayashi |
| 3,787,150 | A | | 1/1974 | Sarich |
| 3,798,897 | A | | 3/1974 | Nutku |
| 3,824,746 | A | | 7/1974 | Watt |
| 3,833,321 | A | | 9/1974 | Telang |
| 3,858,559 | A | | 1/1975 | Thomas, Jr. |
| 3,873,247 | A | | 3/1975 | Boes |
| 3,873,253 | A | | 3/1975 | Eickmann |
| 3,890,069 | A | | 6/1975 | Telang |
| 3,892,502 | A | | 7/1975 | Pritchard |
| 3,909,162 | A | | 9/1975 | Nutku |
| 3,913,198 | A | | 10/1975 | Ernest |
| 3,916,738 | A | | 11/1975 | Neubrand |
| 3,933,131 | A | | 1/1976 | Smith |
| 3,938,916 | A | | 2/1976 | Sarich |
| 3,955,540 | A | | 5/1976 | Blanchard |
| 3,964,367 | A | | 6/1976 | Stoferle |
| 3,964,447 | A | | 6/1976 | Normandin |
| 3,971,347 | A | | 7/1976 | Vasilantone |
| 3,976,403 | A | | 8/1976 | Jensen |
| 3,981,276 | A | | 9/1976 | Ernest |
| 4,004,556 | A | | 1/1977 | Pfeiffer |
| RE29,230 | E | | 5/1977 | Sarich |
| 4,079,083 | A | | 3/1978 | Sarich |
| 4,127,367 | A | | 11/1978 | Smith |
| 4,136,661 | A | | 1/1979 | Posson |
| 4,167,922 | A | | 9/1979 | Doundoulakis |
| 4,168,941 | A | | 9/1979 | Rettew |
| 4,227,506 | A | | 10/1980 | Gurley |
| 4,241,713 | A | | 12/1980 | Crutchfield |
| 4,308,002 | A | | 12/1981 | Di Stefano |
| 4,319,551 | A | | 3/1982 | Rubinshtein |
| 4,373,879 | A | * | 2/1983 | Picavet ..... F01C 1/063 418/35 |
| 4,380,220 | A | | 4/1983 | Gurley |
| 4,384,833 | A | | 5/1983 | Shank |
| 4,390,327 | A | | 6/1983 | Picavet |
| 4,403,581 | A | | 9/1983 | Rogachevsky |
| 4,455,128 | A | | 6/1984 | Seybold |
| 4,476,826 | A | | 10/1984 | Stephens |
| 4,572,121 | A | | 2/1986 | Chang |
| 4,617,886 | A | | 10/1986 | Mach |
| 4,667,468 | A | | 5/1987 | Hansen |
| 4,688,531 | A | | 8/1987 | Aase |
| 4,753,073 | A | | 6/1988 | Chandler |
| 4,848,296 | A | | 7/1989 | Lopez |
| 5,086,732 | A | | 2/1992 | Seno |
| 5,220,893 | A | | 6/1993 | Costa |
| 5,261,365 | A | | 11/1993 | Edwards |
| 5,277,158 | A | | 1/1994 | Pangman |
| 5,305,721 | A | | 4/1994 | Burtis |
| 5,345,905 | A | | 9/1994 | Edwards |
| 5,433,179 | A | | 7/1995 | Wittry |
| 5,622,149 | A | | 4/1997 | Wittry |
| 5,685,269 | A | | 11/1997 | Wittry |
| 5,937,820 | A | | 8/1999 | Nagata |
| 5,992,371 | A | | 11/1999 | Raso |
| 6,003,486 | A | | 12/1999 | Vanmoor |
| 6,070,565 | A | | 6/2000 | Miniere |
| 6,125,814 | A | | 10/2000 | Tang |
| 6,244,240 | B1 | | 6/2001 | Mallen |
| 6,257,196 | B1 | | 7/2001 | Alvarado |
| 6,349,695 | B1 | | 2/2002 | Lee |
| 6,457,450 | B1 | | 10/2002 | Luzhkov |
| 6,460,342 | B1 | | 10/2002 | Nalim |
| 6,513,482 | B1 | | 2/2003 | Endoh |
| 6,550,443 | B1 | | 4/2003 | Vanmoor |
| 6,629,829 | B1 | | 10/2003 | Shinoda |
| 6,659,065 | B1 | | 12/2003 | Renegar |
| 6,659,066 | B1 | | 12/2003 | Lee |
| 6,668,767 | B1 | | 12/2003 | Sanchez Talero |
| 6,668,786 | B2 | | 12/2003 | Endoh |
| 6,675,765 | B2 | | 1/2004 | Endoh |
| 6,681,738 | B2 | | 1/2004 | Endoh |
| 6,688,276 | B2 | | 2/2004 | Baptista |
| 6,688,865 | B1 | | 2/2004 | Matsumoto |
| 6,739,307 | B2 | | 5/2004 | Morgado |
| 6,761,143 | B1 | | 7/2004 | Itoh |
| 6,776,136 | B1 | | 8/2004 | Kazempour |
| 6,883,473 | B2 | | 4/2005 | Wondergem |
| 6,886,527 | B2 | | 5/2005 | Regev |
| 6,948,473 | B2 | | 9/2005 | Udy |
| 7,056,107 | B2 | | 6/2006 | Shinoda |
| 7,077,098 | B2 | | 7/2006 | Shuba |
| 7,222,601 | B1 | | 5/2007 | Kamenov |
| 7,461,626 | B2 | | 12/2008 | Kimes |
| 7,614,382 | B2 | | 11/2009 | Hendrix |
| 7,931,006 | B1 | | 4/2011 | Kamenov |
| 8,037,861 | B2 | | 10/2011 | Liang |
| 8,047,824 | B2 | | 11/2011 | Boskovic |
| 8,511,276 | B2 | | 8/2013 | Omori |
| 8,613,269 | B2 | | 12/2013 | Shehter |
| 9,228,489 | B2 | | 1/2016 | Domit |
| 9,546,594 | B2 | | 1/2017 | Beal |
| 9,850,835 | B1 | | 12/2017 | Beal |
| 2005/0016494 | A1 | | 1/2005 | Udy |
| 2008/0276903 | A1 | | 11/2008 | Gorb |
| 2010/0258075 | A1 | | 10/2010 | Samko |

FOREIGN PATENT DOCUMENTS

| | | | |
|---|---|---|---|
| RU | 2117766 | C1 | 8/1998 |
| RU | 2135777 | C1 | 8/1999 |
| RU | 2177063 | C2 | 12/2001 |
| RU | 2281400 | C1 | 8/2006 |
| RU | 2477376 | C2 | 3/2013 |
| RU | 2477377 | C2 | 3/2013 |
| WO | 2016099313 | A1 | 6/2016 |

* cited by examiner

Section A-A

Tear out View D

Section B-B

ROTARY VANE INTERNAL COMBUSTION ENGINE

CROSS-REFERENCE TO RELATED APPLICATIONS

This application is a continuation-in-part of U.S. application Ser. No. 16/894,775 filed on Jun. 6, 2020. The above identified patent application is herein incorporated by reference in its entirety.

BACKGROUND OF THE INVENTION

The present invention relates to rotary machines. More specifically, the invention pertains to a rotary internal combustion engine having a plurality of rotatable vanes.

DESCRIPTION OF THE RELATED ART

Current designs of rotary vane internal combustion engines have serious disadvantages: complicated mechanisms for coordinating movement of the rotors (vanes), increased temperature and wear of surfaces due to friction, availability of reciprocation of working elements.

Russian Patent No. RU2135777C1, comprising a body, a cylinder, two side covers, coaxial shafts; four vanes rigidly mounted on each rotor and placed in a cylinder to form chambers, driving shaft installed in housing eccentrically relative to coaxial shafts and driving member fitted on shaft. Two hinge joints made on driving member accommodate tie-rod connected with single-arm levers rigidly installed on coaxial shafts. Cylinder is provided with suction port and number of delivery holes which can be overlapped to provide control of gas pressure at outlet. However, such a rotary machine described a mechanism for converting the movement of vanes still has large dimensions. The mechanism of coordination of movement of vanes, its diameter and width on many more than the size of the working chamber where there are running cycles. Not eliminated the alternating shock loads because do not provide guaranteed gap acceleration and deceleration of working motors. Disadvantages of this rotary machine and this type of rotary engines are related to difficulties removing the power from two different shafts, each connected to its communication mechanism with vanes that move irregularly and impulsively. Removing power from such shafts of the proposed method is extremely difficult. The required approval of their motion relative to each other is performed using extremely complex and cumbersome mechanism for synchronization. The huge inertial loadings destroy the applied mechanisms of coordination of rotation shafts and related rotor vanes. One of the shortcomings of the RU2135777C1 is rather high temperature of rotors and their vanes. And serious problem of the engine is the seal of clearances and fabrication of working surfaces of the rotor vanes.

U.S. Pat. No. 3,762,375A discloses a rotary vane internal combustion engine comprising a casing defining a rotor chamber of a shape resembling an ellipse. A shaft is journaled in the casing centrally thereof and drivable mounted on the shaft is a rotor presenting a cylindrical surface. The rotor is formed with a plurality of radial slots and sliceable in each slot is a vane. The rotor is also formed with a plurality of combustion chambers opening onto its cylindrical surface. The number of combustion chambers is the same as the numbers of slots with a chamber being located between two adjacent slots. An intake port for an air, gas, oil mixture is formed in the casing and communicating with this port is a pair of channels formed in the casing on opposite sides of the rotor chamber. These channels pass about the shaft where it is journaled in the casing and open onto the rotor chamber at points diametrically opposite to the intake port. A manifold type exhaust is formed in the casing about 30 degree, in the direction of rotation of the rotor from the intake port. A spark plug is mounted on the casing with its points located at the periphery of the rotor chamber. Conductors extend from the spark plug to contacts mounted on the exterior of the casing with the contacts being bridged at periodic intervals by a cam drivable mounted on the shaft. The shaft also drivable carries a gear with which meshes a pinion that is driven by a starting motor.

A rotary-vane internal combustion engine, U.S. Pat. No. 4,403,581A discloses a rotary vane internal combustion engine comprising, in combination, a rotary compressor for forming and igniting a combustible fluid mixture, a rotary power unit, and an expansion chamber that is connected both to the compressor for receiving the ignited mixture, and to the power unit, where the power developed by the expanding ignited combustible mixture in the expansion chamber drives a vane acting on a driven member. In each of the compressor and power units respective rotors are mounted for rotation. A plurality of vanes rotatable supported by a shaft within each rotor rotates with the rotor and slide in slots in guides mounted with the rotor. The rotor within the compressor is mounted eccentrically so that the fluid is compressed before it is ignited and leaves the compressor. The combustible fluid, after ignition, enters the expansion chamber where it drives one or more vanes coupled to the rotor mounted eccentrically within the rotary power unit. The rotor of the power unit is provided with a plurality of slotted guides receiving the vanes as they rotate through the expansion chamber. The vanes slide within the slotted guides and are maintained in constant alignment therewith by an arm coupled to each of the guides and to the rotor shaft, which is an important feature as the vanes of the power rotor leave, at some point during the operation of the engine, their respective slotted guides.

Rotary machines utilizing rotatable vanes attached to a stationary center shaft and extending through a rotatable off-center hollow cylindrical rotor into sliding contact with the wall of a housing are known in the prior art. U.S. Pat. No. 3,892,502 issued to E. Pritchard and U.S. Pat. No. 3,976,403 issued to Jensen is exemplary of such machines. A problem with some prior art rotary vane machines is that they cannot successfully operate under high pressure and heat. This creates an inability to operate under high pressure and heat due to poor seals on the vanes and high torque on the vanes.

U.S. Pat. No. 6,681,738 discloses the rotary-type fluid machine, vane type fluid machine, includes a casing, a rotor and a plurality of vane-piston units which are disposed in a radiate arrangement on the rotor. Each of the vane-piston units has a vane sliding in a rotor chamber and a piston placed in abutment against an on-slide side of the vane. When it functions as an expanding machine, the expansion of a high-pressure gas is used to operate the pistons thereby to rotate the rotor via vanes and the expansion of a low pressure gas caused by a pressure reduction in the high pressure gas is used to rotate the rotor via the vanes. On the other hand, when it functions as a compressing machine, the rotation of rotor is used to supply a low-pressure air to the side of pistons via vanes and further, the pistons are operated by the vanes to convert the low pressure air to the high pressure air. Thus, a rotary-type fluid machine having expanding and compressing functions, with the merits belonging to the piston type and the merits belonging to the vane type, can be provided.

U.S. Pat. No. 6,675,765 B2 discloses rotary-type fluid machine that includes a casing, a rotor and a plurality of vane-piston units which are disposed on the rotor. Each of the vane-piston units has a vane sliding in a rotor chamber and a piston placed in abutment against a non-slide side of the vane. When it functions as an expanding machine, the expansion of a high-pressure gas is used to operate the pistons thereby to rotate the rotor via vanes and the expansion of a low pressure gas caused by a pressure reduction in the high pressure gas is used to rotate the rotor via the vanes. On the other hand, when it functions as a compressing machine, the rotation of rotor is used to supply a low-pressure air to the side of pistons via vanes and further, the pistons are operated by the vanes to convert the low pressure air to the high pressure air. Thus, a rotary-type fluid machine having expanding and compressing functions, with the merits belonging to the piston type and the merits belonging to the vane type, are in confined space where heat removal is significantly impeded. In addition, the vanes have a return-translational movement that aggravates the operation of the mechanism and at high temperatures will jam.

U.S. Pat. No. 4,848,296A discloses the rotary internal combustion engine comprising a cylindrical casing and a cylindrical rotor. Several stepped crankshafts rotatable connected to the rotor pass through the ends of the casing, thereby confining motion of the rotor o orbital motion. Radial vanes extend from an axial shaft in the casing to the inner surface of the casing wall and form seals against the casing. Combustion chambers are formed between adjacent vanes. Intake, exhaust, and ignition systems provide a combustion cycle for each chamber as the rotor orbits and cannot be cooled and cannot readily be lubricated so is very susceptible to overheating, which keeps it from being usable, and can't eliminate the reciprocating movement of the vanes.

U.S. Pat. No. 4,241,713A discloses a rotary internal combustion engine having housing defining chambers through which extends coaxially a shaft. A plurality of vanes is pinned to a collar which is relative about the shaft. One vane is rigidly secured to the collar. A cylindrical drum is positioned in the working chamber with the centerline of the drum radially offset from the centerline of the working chamber. The vanes extend through slots or apertures in the rotor to close proximity with the chamber wall. A fuel delivery system communicates with the chamber through approximately 90 degrees of the compression cycle. An exhaust opening communicates with the chamber at the end of the expansion cycle whereby the compression ratio is substantially less than the expansion ratio. In one embodiment means are provided to vary the compression and expansion ratios. Because the engine cannot be cooled and cannot readily to be lubricated, it is very susceptible to overheating. This keeps it from being usable and can't eliminate the reciprocating movement of the vanes.

U.S. Pat. No. 3,964,447A discloses a rotary vane internal combustion engine, which includes two separate housings, compressor, housing and a motor housing. A rotor is rotatably mounted in each housing and includes a system of partially unbalanced vanes slidably mounted in these openings and bearing at each extremity thereof against the interior profile of the related housing. Each vane defines in the housing chambers of variable volume depending on the relative rotational position of each segment with respect to the housing profile. Both housings are similarly structured with the exception that the compressor housing includes two sections of constant radius. Each housing includes inlet and outlet meant for the entry and exhaust of fluids. The vanes working under load having the reciprocating movement, however, cannot be cooled and cannot readily to be lubricated, so are very susceptible to overheating, which prevents the engine from being usable.

U.S. Pat. No. 3,955,540A discloses a rotary internal combustion engine, which includes a housing having a cylindrical inner peripheral wall surface a hollow, cylindrical rotor rotatable shaft-mounted in the housing in eccentric relationship with respect to the housing, a cylindrical vane track positioned in the hollow cavity of the rotor and located in the center of the housing, and vanes slide and radially disposed in the walls of the rotor and adapted to traverse the vane track and inner peripheral wall surface of the housing as the rotor rotates. The rotor and vanes cooperate with the housing to define a plurality of chambers which become successively smaller as they are charged with fuel and approach the firing area of the housing, and larger after combustion as they approach the exhaust and intake segments of the housing, cannot be cooled and cannot readily to be lubricated so are very susceptible to overheating, and prevents it from being usable. U.S. Pat. No. 6,070,565A discloses a rotary internal combustion engine, wherein the rotor has a plurality of vane slots therein and a vane control shaft is mounted at a predetermined fixed position within the center portion of the rotor and has two end portions, one of which is fixedly attached to the engine housing chamber base and at least two vane position control portions positioned between the end portions, so that nested rotors driven crankshaft of the engine. Rotors at the same time, have a complex movement and conditions and can't be cooled and can't readily to be lubricated, so they are very susceptible to overheating, which prevents the engine from being usable.

U.S. Pat. No. 5,305,721A discloses a rotary Wankel-type internal combustion engine system, wherein the crankshaft is supported by a center main roller bearing. The rotor apexes are sealed by a two-piece apex seals and by side seals. The engine system further includes an oiling system which permits oil flow through the center bearing and through lubrication passages in the engine rotor to provide a means for cooling the engine rotor under high loading conditions. Riblets are defined in the combustion face of the rotor to promote aerodynamic lateral stratified charge control to minimize atomized fuel charge loss to surface wetting before ignition.

U.S. Pat. No. 4,004,556 discloses a rotary internal combustion engine of axial sliding-vane type, has sinusoidal shaped side walls with compensation of the mass forces allowing nearly friction-free and high-speed operation with sufficient compression ratio. High power output is believed to make the invention comparable to the well-known Wankel engine. The various designs of the rotary machines can also be used as fluid pumps or fluid-operated motors.

U.S. Pat. No. 4,403,581A discloses a rotary-vane internal combustion engine comprising in combination, a rotary compressor for forming and igniting a combustible fluid mixture, a rotary power unit, and an expansion chamber that is connected both to the compressor for receiving the ignited mixture, and to the power unit, where the power developed by the expanding ignited combustible mixture in the expansion chamber drives a vane acting on a driven member. In each of the compressor and power units respective rotors are mounted for rotation, A plurality of vanes rotatably supported by a shaft within each rotor rotates with the rotor and slide in slots in guides mounted with the rotor. The rotor within the compressor is mounted eccentrically so that the fluid is compressed before it is ignited and leaves the compressor. The combustible fluid, after ignition, enters the expansion chamber where it drives one or more vanes coupled to the rotor mounted eccentrically within the rotary power unit. The rotor of the power unit is provided with a plurality of slotted guides receiving the vanes as they rotate through the expansion chamber. Disadvantage is that the vanes slide within the slotted guides and are necessary to maintained in constant alignment therewith by an arm coupled to each of the guides and to the rotor shaft, which is an important negative feature as the vanes of the power rotor leave, at some point during the operation of the engine, their respective slotted guides can be destroyed.

U.S. Pat. No. 4,476,826 discloses a rotary internal combustion engine having a stationary casing, and a rotor mounted for rotation about an axis eccentric to the casing forming a crescent shaped compression chamber and a separate crescent shaped expansion chamber. Intake and exhaust ports in the casing respectively communicate with the compression and expansion chambers and first and second vanes angularly spaced apart on the rotor slid ably engage the walls of the respective compression and expansion chambers. A rotary transfer valve is provided on the rotor intermediate the first and second vanes to alternately communicate with the compression and expansion chambers. The charge of combustible mixture is ignited while in the transfer valve. When the charge of the combustible mixture ignited it is practically difficult to coordinate the radial movement of the blade with the cam, where the rotational and translational movements must coincide U.S. Pat. No. 5,086,732 discloses a four-stroke concentric oscillating rotary vane internal combustion engine performs the four stroke Otto cycle inside four arcuate combustion chambers formed between the shell, rotor cylinder and two transverse end plates analogous to the engine cylinder; two fixed diametrically opposed vanes inwardly projecting from the shell serving as cylinder heads; and two fixed diametrically opposed vanes projecting outwardly from the rotor cylinder functioning as pistons. An output shaft mechanism orchestrates the synchronized operations of the fuel injection and spark ignition systems, pair of cranking mechanisms controlling the rotary strokes of the rotor, and pair of forced porting mechanisms forcing the complete removal of combustion byproducts from and sufficient supply of air into the combustion chambers. The big disadvantage is that the output shaft of forced porting mechanism forcing orchestrating the synchronized operations of the fuel injection and spark ignition systems.

U.S. Pat. No. 5,277,158 discloses the multiples vane rotary internal combustion engine, a three-piece housing enclosing a cavity has rotatable mounted therein a rotor having a plurality of slots, each slot supporting a vane. Each vane has a retention end guided in its revolution around the rotor by an internal, non-circular vane retention track. Two adjacent vanes define opposite sides of a combustion chamber, while the housing and the portion of the rotor between the adjacent vanes form the remaining surfaces of the combustion chamber. Each combustion chamber is rotated past an intake port, a diagonal plasma bleed-over groove, and an exhaust port to accomplish the phases of a combustion cycle. Fuel ignition is provided to more than one combustion chamber at a time by expanding gases passing through a plasma bleed-over groove and being formed into a vortex that ignites and churns the charge in a succeeding combustion chamber. Exhaust gases remaining after primary evacuation are removed by a secondary evacuation system utilizing a venture creating negative pressure which evacuates the combustion chamber. Lubrication is circulated through the engine without the use of a lubricant pump. The centrifugal force of the rotating rotor causes the lubricant therein to be pressurized thereby drawing additional lubricant into the closed system and forcing lubricant within the engine to be circulated. However, it is a very complex rotor with many grooves, with each slot supporting a void. Each blade must be held during a shocking movement guided by rotation around the rotor along the inner non-circular guide to hold the blade.

U.S. Pat. No. 6,550,443B1 discloses a rotary internal combustion engine having a cylindrical rotor which rotates in a cylindrical rotor chamber of a stator. A cylindrical peripheral surface of the rotor rotates equidistantly from the housing wall of the rotor housing. A plurality of vanes project radially from the peripheral surface of the rotor are sealing against the inner wall surface of the rotor housing. Several turning or reciprocating valves are equal-angularly distributed about periphery of the housing chamber. The valves seal against the rotor periphery and they open up for the vanes to pass by.

U.S. Pat. No. 6,513,482 discloses a rotary-type fluid machine that includes a casing, a rotor and a plurality of vane-piston units, which are disposed in a radiate arrangement on the rotor. Each of the vane-piston units has a vane sliding in a rotor chamber and a piston placed in abutment against a non-slide side of the vane. When it functions as an expanding machine, the expansion of a high-pressure gas is used to operate the pistons thereby to rotate the rotor via vanes and the expansion of a low-pressure gas caused by a pressure reduction in the high-pressure gas is used to rotate the rotor via the vanes. On the other hand, when it functions as a compressing machine, the rotation of rotor is used to supply a low-pressure air to the side of pistons via vanes and further, the pistons are operated by the vanes to convert the low-pressure air to the high pressure air. Thus, a rotary type fluid machine having expanding and compressing functions, with the merits belonging to the piston type and the merits belonging to the vane type, can be provided.

The rotor and a plurality of vane-piston assemblies that are located in a radiation arrangement on the rotor have a translational and rotational movement, which greatly complicate and renders the whole process unreliable.

U.S. Pat. No. 6,668,786 discloses a rotary type fluid machine includes a casing, a rotor and a plurality of vane-piston units which are disposed in a radiate arrangement on the rotor. Each of the vane-piston units has a vane sliding in a rotor chamber and a piston placed in abutment against a non-slide side of the vane. When it functions as an expanding machine, the expansion of a high-pressure gas is used to operate the pistons thereby to rotate the rotor via vanes and the expansion of a low pressure gas caused by a pressure reduction in the high pressure gas is used to rotate the rotor via the vanes. On the other hand, when it functions as a compressing machine, the rotation of rotor is used to supply a low-pressure air to the side of pistons via vanes and further, the pistons are operated by the vanes to convert the low pressure air to the high pressure air. Thus, the patent discloses a rotary type fluid machine having expanding and compressing functions, with the merits belonging to the piston type and the merits belonging to the vane type.

U.S. Pat. No. 7,077,098 discloses a rotary internal combustion engine having a hollow stator with inner surface formed by two concentric cylindrical surfaces, which fluently transit one into the other via ramp surfaces, and a cylindrical rotor, having the same radius as smaller concentric surface of the stator. The rotor has vanes that move radially within the rotor tightly contouring the inner surface of the stator during rotor rotation. The cavities within the stator where its inner radius equals that of the rotor constitute combustion chambers, which connect to the variable-volume working chambers formed by outer surface of the rotor, inner surface of the stator with bigger radius and the side of the vane via valve-controlled orifices ending in the areas of the stator amp surfaces. During rotor rotation the vanes provide compression of fuel mixture into combustion chambers and accept the energy of expanding gasses following fuel mixture ignition in the combustion chamber.

U.S. Pat. No. 9,546,594 discloses a guided-vane rotary internal combustion engine including a plurality of working chambers which are separated from one another by way of vane assemblies which rotate with a rotor assembly about an axis employs a rotor assembly having a plurality of sectors wherein each sector is associated with a corresponding working chamber and a plurality of spark plugs wherein each spark plug is mounted within a corresponding sector for igniting an air/fuel mixture contained within a corresponding working chamber. A rotor disk is mounted upon the rotor assembly for rotation therewith and acts as a distributor through which energizing charges are conducted to the spark plugs. In addition, a controller is utilized for selectively activating or de-activating the working chambers of the engine upon the occurrence of a predetermined event.

U.S. Pat. No. 9,850,835 discloses a guided-vane rotary internal combustion engine including a plurality of working chambers which are separated from one another by way of vane assemblies which rotate with a rotor assembly about an axis employs a rotor assembly having a plurality of sectors wherein each sector is associated with a corresponding working chamber and a plurality of spark plugs wherein each spark plug is mounted within a corresponding sector for igniting an air/fuel mixture contained within a corresponding working chamber. A rotor disk is mounted upon the rotor assembly for rotation therewith and acts as a distributor through which energizing charges are conducted to the spark plugs. In addition, a controller is utilized for selectively activating or de-activating the working chambers of the engine upon the occurrence of a predetermined event.

The US patent application US20050016494A1 discloses four-cycle rotary engines with an even number of hinged-hub impeller vanes, independently rotating, joined, hinged-hub impellers, with interdigitated, alternating hub sections, on a shared, power output shaft, and electromagnetic fields, and timing of impeller release and capture, to provide real time compression ratio control, and to control the momentum of the rotating impellers, and mechanical clutches to transfer the rotation to the power shaft.

The US patent application US20100258075A1 discloses a rotary internal combustion engine consisting of stator and two co-axial rotors with two vanes on each by introducing in it the reducing gear, including main shaft, rotors shafts and auxiliary device shaft, on which the two-tooth gears are mounted. The crown of the two-tooth gears has a shape of mating convex and concave arcs, which teeth meshing ensures a kinematic interaction of the rotor shaft gears with the main shaft gears and with the auxiliary device gears. The mechanism ensures reliable transmission of torsion torques from rotors shafts to the power take-off shaft, optimum compression degree of air-fuel mixture in the compression and combustion chambers, a rational correlation between the maximum and minimum rotors revolution velocity during their operation, given relative position of rotors, shafts and gears in a static, pre-starting state of the engine.

International publication WO2016/099313 discloses internal combustion engines having rotary-vane-type construction, with two movable gas-distribution paddle valves, which, depending on the selected construction, are controllable by means of electric drives, pneumatic drives, hydraulic drives controllable by electronics, or mechanically with the aid of distribution shafts drivable with a chain or a belt. A rotary-vane-type steam-driven pneumatic engine has an analogous construction, with the exception of controllable paddle valves not being present.

The above-listed prior art includes the following disadvantages:

The presence of reciprocating movement of the working elements;

The use of complex and unreliable mechanisms to synchronize movement between the vanes;

Lack of cooling of the working area of the engine;

Lack of the possibility of intensive lubrication of working surfaces.

What is needed is a new design of a rotary vane internal combustion engine that eliminates the above disadvantages, does not use reciprocating mechanisms, and eliminates the need to synchronize rotation of the rotors by having the rotors lack a rigid connection with the shaft.

In addition, what is needed is a rotary vane internal combustion engine having an intensive cooling system that prevents the engine from overheating.

BRIEF SUMMARY OF THE INVENTION

Present invention provides a rotary vane internal combustion engine comprising two side-by-side rotors 3 and 4, wherein each rotor has at least two radial vanes, rigidly attached to the rotor's sleave or integrally formed with the rotor's sleave for rotation within a cylindrical cavity of the housing 9. The side-by-side rotors are assembled together to form at least one set of four radially distributed chambers. On each side the vanes of the rotor assembly are closed by a rigidly mounted side-flange 5 that eliminates need to seal the chambers from the side.

Together with engine housing 9, the rotor assembly forms at least four engine compartments in which occurs the intake I, compression C, combustion S, and exhaust E, respectively. Each rotor 3 and 4, alternately engages with an axial shaft 1 by means of one-way overrunning clutches which ensures its continuous rotation by attaching one rotor and free passing through the other rotor, and in contrary. To avoid the reverse rotation of rotors 3 and 4 and ensure continuous, smooth rotation of shaft 1, applied are the adjustable flywheel assemblies 12, which are connected with a corresponding unlocked rotor through rotor-holding cushioning mechanism (damper) 14, allowing maintaining of positioning in the inertial rotation of the rotors with the shaft. Those eliminate the need for the use of unreliable mechanisms of synchronization of the movement between vanes.

In order to avoid heating of the one-way overrunning clutches 8, they are placed outside of the heating zone and are separated from the heating zone by a cavity of cooling pump, which provides an easy access for servicing. On the outer side of side-flanges 5 of the assembled rotors 3 and 4 are rigidly mounted (at different angular directions to the radial axis) the left/right blade pairs 28 and 29, that with caps 6 form a cooling pump having two cooling cavities (where one cavity works to pull in a coolant and the other to push out the coolant) that provide circulation of the cooling fluid around rotors through housing, due to at least two holes in the housing and at least two longitudinal grooves in the shaft. The present invention integrates the housing cooling and the rotary cooling system is to provide more effective circulation of the coolant, that allows to significantly increase reliability of the rotary vane internal combustion engine.

In order to eliminate sliding friction in the engine, the present invention uses the graphite roller seals 18 and 19 for cylindrical surface and conical seals 17 for end surfaces, that excludes the need for intensive lubrication. Thus, the present invention creates outstanding conditions for cooling and lubrication of engine.

Engine start is carried out by the forcible fuel-mixture injection using the inlet valves 26, managed by pressure sensors. As presented in this invention, the term "fuel mixture" includes a mixture of any type of fuel (e.g., gasoline, natural gas, etc.) with oxygen, for combustion purposes. The inlet valves 26 are used one time on start for two chambers, one chamber at a compression position "C" and the other chamber at a combustion position "S", at the same time, to allow for balanced compression ratio, which corresponds to a certain pressure value. After which the ignition is activated (triggered) in the first chamber in position S, thereby leading the second chamber, in position C to move into position S for next ignition. Thereafter the engine continues to work in a traditional (regular) cycle.

Below is the detailed description of the invention. Conventionally the drawings show that the structures for one-way overrunning clutches are roller/ball clutches, but the invention doesn't exclude application of electromagnetic or other one-way clutches.

The invented engine in the work is equivalent to eight-piston engine, if using two vanes on each rotor, whereas one revolution (turn) realizes four running cycles; or as to sixteen-piston engine, if using four vanes on each rotor, whereas one turn realizes eight running cycles.

In one embodiment, the rotary vane internal combustion engine of the present invention comprises a first flywheel assembly rigidly connected to a shaft and comprising a first damper; a second flywheel assembly rigidly connected to the shaft and comprising a second damper; a cylindrical housing; a rotor assembly located in the cylindrical housing and comprising (a) a pair of side-by-side rotors, wherein a first rotor of the pair of side-by-side rotors includes an at least two radial vanes, the at least two radial vanes of the first rotor extending over a second rotor of the pair of side-by-side rotors, and wherein the second rotor includes an at least two radial vanes, the at least two radial vanes of the second rotor extending over the first rotor; and (b) a pair of side-flanges, wherein a first side-flange of the pair of side-flanges is rigidly attached to the second rotor and closes off at least a part of a first side of the rotor assembly and wherein a second side-flange of the pair of flanges is rigidly attached to the first rotor and closes off at least a part of a second side of the first rotor.

The pair of side-by-side rotors and the pair of side-flanges form an at least one set of four radially spaced chambers, wherein the at least one set of four radially spaced chambers cooperates with the cylindrical housing to form a corresponding at least one set of four radially spaced engine-compartments, wherein each of the pair of side-by-side rotors alternately engages with the shaft by a corresponding one-way overrunning clutch of a pair of one-way overrunning clutches to rotate the shaft in a forward direction; wherein, during the first rotor's engagement with the shaft, the second damper couples to the second rotor for a time period comprising a first momentary duration and a first subsequent duration, such that (i) during the first momentary duration the second damper counters a deceleration of a forward rotation of the second rotor and (ii) during the first subsequent duration the second flywheel assembly forces the second rotor to continue rotating in the forward direction; and wherein, during the second rotor's engagement with the shaft, the first damper couples to the first rotor for a time period comprising a second momentary duration and a second subsequent duration, such that (i) during the second momentary duration the first damper counters a deceleration of a forward rotation of the first rotor and (ii) during the second subsequent duration the first flywheel assembly forces the first rotor to continue rotating in the forward direction.

In the rotary vane internal combustion engine of the present invention, the first and second rotors are mechanically unsynchronized with each other during their respective rotations.

The cylindrical housing comprises an at least one set of four radially distributed segments comprising an ignition segment (Ss), a compression segment (Cs), an intake segment (Is), and an exhaust segment (Es); wherein the intake segment includes a fuel-mixture supply port; wherein the exhaust segment includes a gas-exhaust port; wherein the ignition segment is coupled to a first fuel-mixture inlet valve, the ignition segment comprises a spark plug for igniting a fuel mixture in an engine-chamber having the ignition segment; and wherein the compression segment is coupled to a second fuel-mixture inlet valve. During an engine start operation, the first and second fuel-mixture inlet valves are configured to inject the fuel mixture into a pair of chambers that are aligned with the ignition and compression segments, respectively.

In one embodiment of the invention, the first side-flange is rigidly attached to the second rotor via the at least two radial vanes of the second rotor, and wherein the second side-flange is rigidly attached to the first rotor via the at least two radial vanes of the first rotor.

In one embodiment of the invention, the rotary vane internal combustion engine further comprises a first cylindrical seal positioned between an upper surface of each respective radial vane, of the at least two radial vanes of the first rotor and of the at least two radial vanes of the second rotor, and an inner surface of the cylindrical housing; a second cylindrical seal positioned between a lower surface of each respective radial vane of the at least two radial vanes of the first rotor and a radial surface of the second rotor; a third cylindrical seal positioned between a lower surface of each respective radial vane of the at least two radial vanes of the second rotor and a radial surface of the first rotor; a first conical seal positioned between a first side surface of each respective radial vane, of the at least two radial vanes of the first rotor and of the at least two radial vanes of the second rotor, and an inner surface of the first flange; and a second conical seal positioned between a second side surface of each respective radial vane, of the at least two radial vanes of the first rotor and of the at least two radial vanes of the second rotor, and an inner surface of the second flange. At least one of the first cylindrical seal, the second cylindrical seal, the third cylindrical seal, the first conical seal, and the second conical seal comprises a low-friction material.

In the rotary vane internal combustion engine of the present invention, each of the first and second dampers counters a deceleration of a forward rotation of the first rotor and the second rotor, respectively, by absorbing a corresponding rotor's deceleration energy. During the first subsequent duration, the second damper uses at least a portion of the absorbed energy to accelerate rotation of the second rotor in the forward direction, and during the second subsequent duration, the first damper uses at least a portion of the absorbed energy to accelerate rotation of the first rotor in the forward direction.

In one embodiment of the invention, energy-absorption characteristic of each of the first and second dampers is adjustable.

The invention is not limited to a particular type of dampers, and contemplates using mechanical, hydraulic, or pneumatic dampers known in the art. In one embodiment of the invention the first damper includes a first spring, and the second damper includes a second spring. The spring may be a coiled spring.

The flywheel assemblies may each comprise a damper-guide on which a damper is fitted.

The invention also does not limit the type of one-way overrunning clutches known in the art. In one embodiment of the invention, each of the one-way overrunning clutches is selected from a set comprising a ball clutch, a roller clutch, and a magnetic clutch.

The rotary vane internal combustion engine of the present invention can further comprise a first adapter coupling the first rotor to (i) the first rotor's corresponding one-way overrunning clutch and (ii) the first flywheel assembly; and a second adapter coupling the second rotor to (i) the second rotor's corresponding one-way overrunning clutch and (ii) the second flywheel assembly.

The rotary vane internal combustion engine includes a cooling system that allows circulation of a lubricating-coolant fluid. In one embodiment of the invention, the engine comprises a cylindrical housing comprising a coolant-intake opening and a coolant-output opening; a shaft having an at least two longitudinal grooves; a rotor assembly located in the cylindrical housing and having a first side-flange and a second side-flange. A first cap is attached to a first end of the cylindrical housing and, together with the first side-flange, forms a coolant-intake cavity. A second cap attached to a second end of the cylindrical housing and, together with the second side-flange, forms a coolant-output cavity. The coolant-intake opening, the coolant-intake cavity, the at least two longitudinal grooves, the coolant-output cavity, and the coolant-output opening form a cooling channel for circulation of a lubricating coolant. The rotor assembly comprises a pair of side-by-side rotors alternately engaging with the shaft by a corresponding one-way overrunning clutch of a pair of one-way overrunning clutches to force the shaft to rotate in a forward direction, wherein the pair of one-way overrunning clutches is located outside a heat zone of the rotor assembly.

In one embodiment, each of the first side-flange and the second side-flange comprises a pair of blades, respectively, for forcing the lubricating coolant to pass through the cooling channel. The pair of blades of the first side-flange may be oriented in a different angular direction relative to a radial axis than the pair of blades of the second side-flange.

In one embodiment of the invention, instead of using the blades, or in combination with the blades, an external cooling pump may be used to pump the lubricating-coolant through the channel.

In one embodiment of the invention, the engine may further comprise an additional cooling channel. This additional cooling channel passes through the cylindrical housing between the coolant-intake opening and the coolant-output opening.

The invention also includes a method of starting a rotary vane internal combustion engine as described above, and comprising a cylindrical housing that includes an at least one set of four radially distributed segments comprising an intake segment (Is) having a fuel-mixture supply port, an exhaust segment (Es) having a gas-exhaust port, an ignition segment (Ss) comprising a spark plug and coupled to a first fuel-mixture inlet valve, and a compression segment (Cs) coupled to a second fuel-mixture inlet valve; and a rotor assembly located in the cylindrical housing and comprising an at least one set of four radially spaced chambers that rotatably align with the at least one set of four radially distributed segments of the cylindrical housing to form an at least one set of four radially spaced engine-compartments including an intake compartment (I), an exhaust compartment (E), an ignition compartment (S), and a compression compartment (C), wherein the ignition compartment initially includes the ignition segment in alignment with a first chamber, the compression compartment initially includes the compression segment in alignment with a second chamber, the intake compartment initially includes the intake segment in alignment with a third chamber, and the exhaust compartment initially includes the exhaust segment in alignment with a fourth chamber.

In one embodiment, the method comprises the steps of (a) using the first and second fuel-mixture inlet valves to inject a fuel mixture into the first chamber and the second chamber, respectively; (b) using the spark plug to ignite the fuel mixture in the first chamber, thereby forcing rotation of the rotor assembly within the cylindrical housing such that the second chamber moves into alignment with the ignition segment, thus reconfiguring the ignition compartment to include the ignition segment and the second chamber with the fuel mixture therein; and (c) using the spark plug to ignite the fuel mixture in the reconfigured ignition compartment, thereby forcing further rotation of the rotor assembly within the cylindrical housing.

On one embodiment, the step of using the first and second fuel-mixture inlet valves to inject a fuel mixture into the first and second chambers may include injecting the fuel mixture into the first and second chambers at equal or substantially equal pressure levels. Moreover, the injection(s) into the first and second chambers may be done simultaneously or substantially simultaneously. One skilled in the art understands that rotation of the rotor assembly causes the fuel mixture to be drawn (i.e., pull in, sucked in) through the fuel-mixture supply port into a chamber that passes underneath, on its way to aligning with the compression segment (Cs).

As disclosed above, the engine start process includes two separate ignitions in the ignition compartment S. Each ignition, however, causes a separate rotation of the rotor assembly, reconfiguring the compartments. Thus, due to the first ignition in the engine start process, rotation of the rotor assembly: (i) causes the resulting gases in the first chamber to be exhausted through the gas-exhaust port as the first chamber rotates into alignment with the exhaust segment (Es); (ii) causes the second chamber, with the pressurized fuel mixture therein, to move into alignment with the ignition segment (Ss); (iii) causes the fuel mixture to be drawn through the fuel-mixture supply port into the third chamber as the third chamber rotates into alignment with the compression segment (Cs), and while the second chamber rotates into alignment with the ignition segment (Is). The second ignition in the engine start process initiates a further rotation of the rotor assembly, at which point the engine begins operating in the regular (Otto) cycle, which is known in the art.

BRIEF DESCRIPTION OF THE DRAWINGS

The illustrated embodiments of the subject matter will be best understood by reference to the drawings, wherein like parts are designated by like numerals throughout. The following description is intended only by way of example, and simply illustrates certain selected embodiments of devices, systems, and processes that are consistent with the subject matter as claimed herein

DETAILED DESCRIPTION OF THE INVENTION

The present invention provides a rotary vane internal combustion engine where torque on the shaft is produced due to alternating interaction of the rotors within. The rotors placed in housing between two cooling cavities, around which cooling fluid is circulated, may have conical and cylindrical graphite seals to eliminate friction between the work surfaces. This invention relates to improvement of rotary vane internal combustion engine and will be described with reference to the following drawings.

Figure 1:
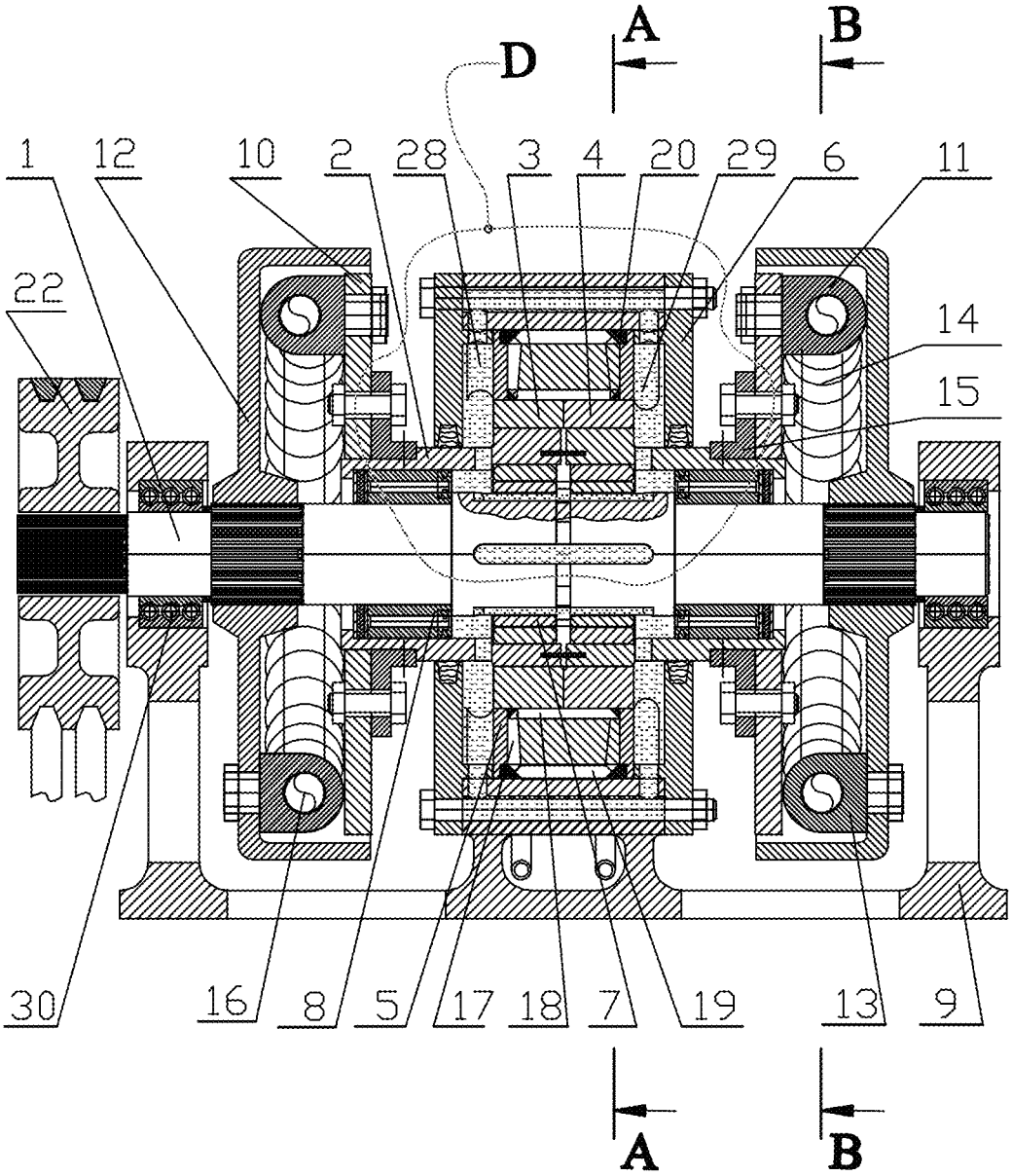
FIG. 1 is a section view along the axis line of rotary vane internal combustion engine of the present invention.

As shown on the drawing FIG. 1, rotary vane internal combustion engine related to one embodiment of the present invention comprises a housing 9, inside which set a shaft 1, which interacts with rotors 3 (left) and 4 (right) through one-way overrunning clutches 8, which are rigidly joined with the rotors 3 and 4 by adapters 2. One side of each rotor is rigidly closed by flanges 5, which together with caps 6 form the cavities for circulation the cooling fluid by the right and left blades 29 and 28 mounted on the flanges 5. The drawing in FIG. 1 shows the rotor-holding cushioning mechanism (damper) 14, where flywheels 12, rigidly mounted on shaft 1, interact with rotors 3 or 4 using the dampers 14, fitted on the guides 16. The one end of the guide 16 is rigidly mounted on its respective flywheel 12 using adjustable holder 13. The other end, using holder 11, is mounted on washer 10. The washer 10 is rigidly connected with a rotor using adapter 2 via coupler 15. The drive shaft 1 is installed on the two bearings 30 and on the middle bearing shells 7, thereby it is supported in three places. At least one end of the shaft is used for transferring torque.

Figure 2:
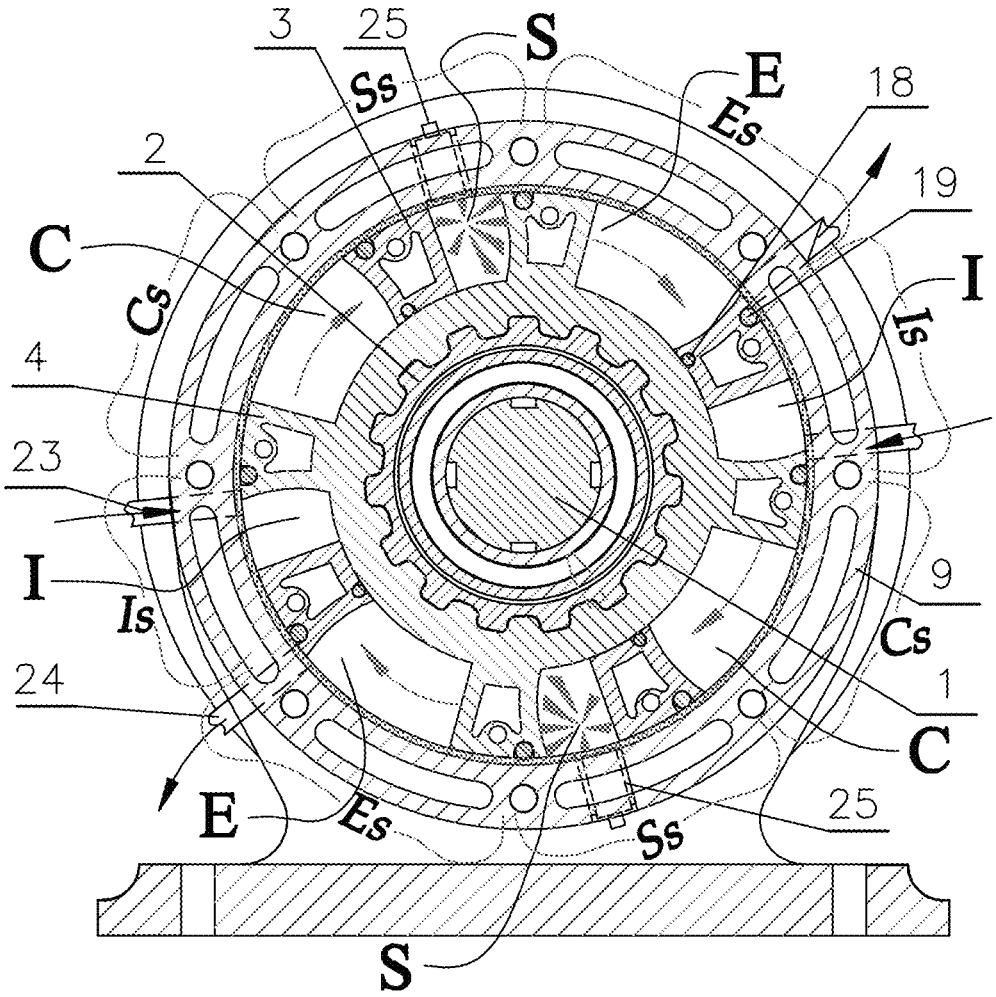
FIG. 2 is a transverse section along the lines A-A of FIG. 1 of rotary vane internal combustion engine of the present invention.

For the purpose of demonstration of the principles of work the present invention is illustrated on the drawing FIG. 2, section A-A, where the rotors 3 and 4, having four (at least two) vanes, established in the housing 9, to provide eight (at least four) chambers, two (at least one) at intake position(s) I, two (at least one) at compression position(s) C, two (at least one) at explosion (ignition) position(s) S, and two (at least one) at exhaust position(s) E. The housing 9 includes eight (at least four) segments, two (at least one) is segments at the intake position(s) I, two (at least one) Cs segments at compression position(s) C, two (at least one) Ss segments at ignition position(s) S, and two (at least one) Es segments at exhaust position(s) E. The Is and Es segments have fitting systems of 23 and 24, respectively, for providing fuel-mixture supply and for exhausting gases, respectively. A chamber in alignment with the Is segment forms an intake engine-compartment I, a chamber in alignment with the Cs segment forms a compression engine-compartment C, a chamber in alignment with the Ss segment forms an ignition engine-compartment S, a chamber in alignment with the Es segment forms an exhaust engine-compartment E. On the rotors 3, 4 that are rigidly connected with adapters 2, we can see the seals 18 and 19. Engine start is carried out by the forcible fuel-mixture injection using the inlet valves 26, managed by pressure sensors (not shown) that provide balanced compression ratio one time in two chambers aligned with positions C and S, i.e., in the compression and ignition compartments (see FIG. 10).

Figure 3:
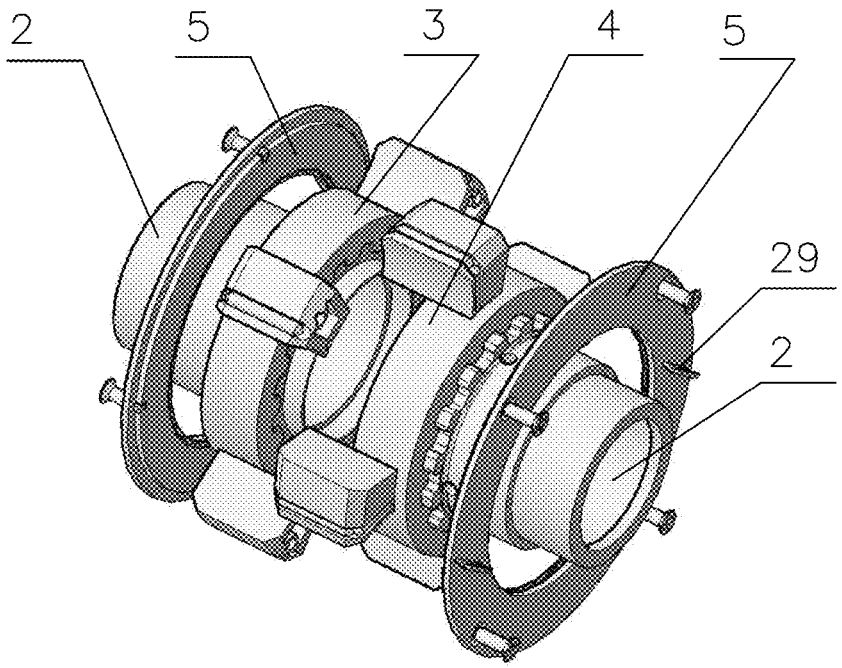
FIG. 3 is an exploded perspective view of the rotors of rotary vane internal combustion engine of the present invention.
Figure 4:
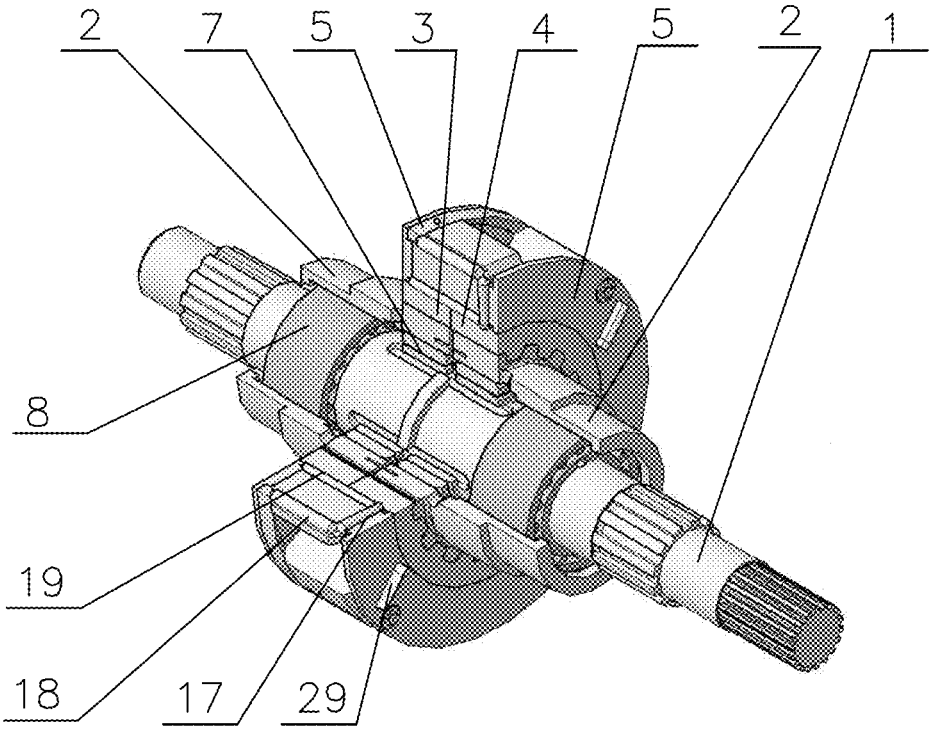
FIG. 4 is a perspective view of the assembled rotors of rotary vane internal combustion engine of the present invention.

Drawing FIG. 3 shows an exploded, and on the FIG. 4 assembled, views of the left and right rotors 3 and 4, respectively, which are closed by two flanges 5 with the cylindrical 18, 19 and conical 17 seals. On the said flanges are mounted blades 28 and 29 for pumping cooling fluid.

Figure 6:
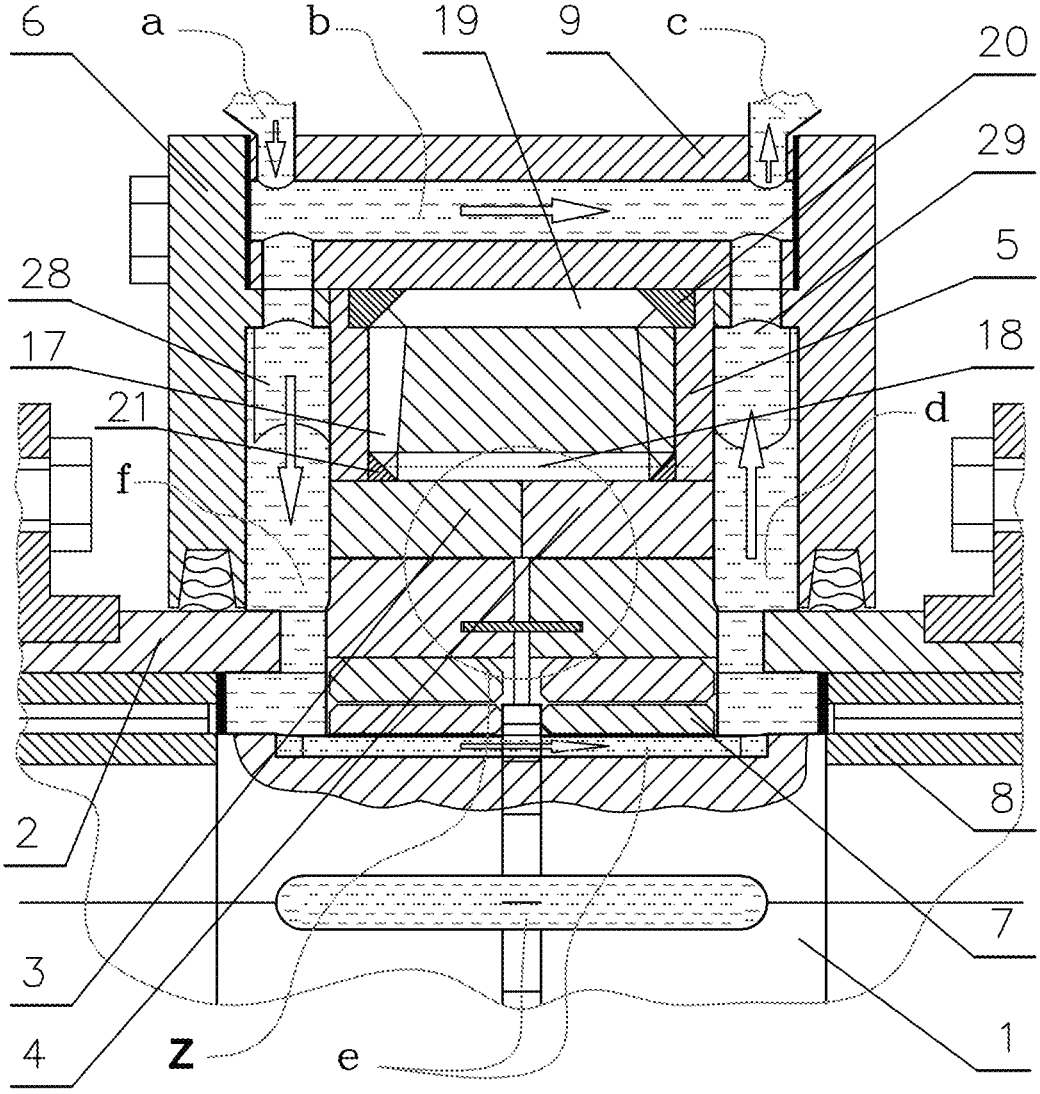
FIG. 6 is a detail out of the section view D in FIG. 1 of rotary vane internal combustion engine of the present invention.

On the drawing FIG. 6, a demonstration of the principle of cooling system, which is a detail of the cut-away D of FIG. 1 of rotary vane internal combustion engine of the present invention, with the coolant flow traced all the way (a, b, e, d, f and e) around the engine. The coolant enters the engine through hole a (intake opening), from the coolant tank, distributed into cavity of the housing 9, between rotor and housing cap of left side, passes through hole f of the adapter 2 and through groove e of the shaft 1, and enters into cavity of right side through hole d. Then the coolant returns into the tank through hole e (output opening) through housing 9. The tight and left blades 29 and 28, located on the right and left flanges 5, respectively, provide circulation of the coolant due to being rigidly mounted at different inclinations (angles) to the radial axis. The cut-away section D also shows the conical 17, and cylindrical 18, 19 graphite seals with sealing rings 20 and 21 that are installed in the assembled rotors. Another cooling path shown in FIG. 6 is from hole a to hole c via a channel in the housing 9. The proposed solution, as illustrated on the cut-away D, to place the one-way overrunning clutches 8 outside of the heating area of the engine provides reliable operation of the engine and is one of the important distinctions of the present invention.

Figure 7:
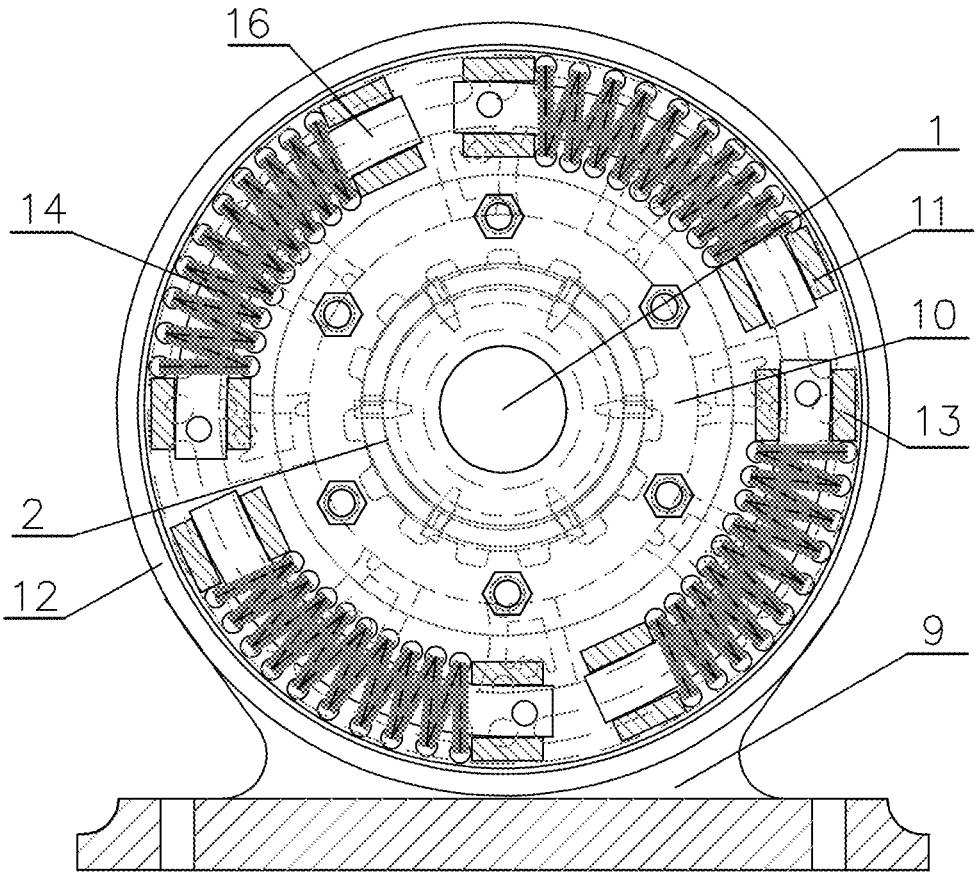
FIG. 7 is a transverse section along the lines B-B on FIG. 1 of the rotor-holding cushioning mechanism of rotary vane internal combustion engine of the present invention.
Figure 8:
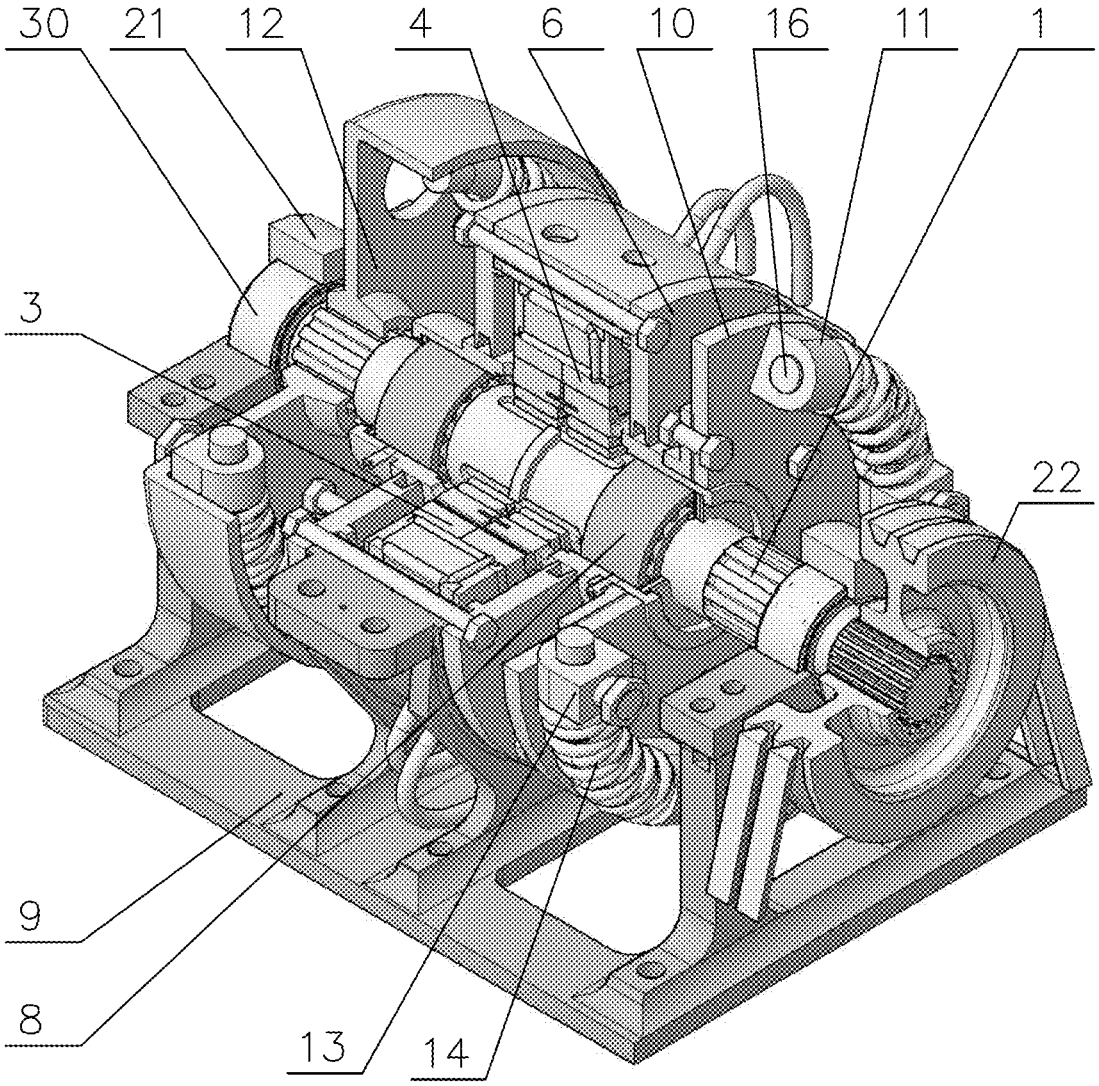
FIG. 8 is a perspective view of the assembled rotary vane internal combustion engine with the rotor-holding cushioning mechanism of the present invention.

The principle of work of the cushioning mechanism (damper) 14, which holds the rotor 3 or 4 from turning back is illustrated on the drawings FIG. 7, which is section B-B of FIG. 1, and on the perspective view FIG. 8. As illustrated, the shaft 1 is in engagement alternately with one of rotor (for example 3) and passes freely through the other rotor (for example 4), where the other rotor (e.g., 4) continues to rotate with the shall 1 due to a damper 14 of its corresponding rotating flywheel 12, which holds the said other rotor 4 until the cycle changes. The process of the disconnecting rotor 3 or 4 from the shaft 1 is controlled by said rotor-holding cushioning mechanism (damper) 14 that can be adjusted by holder 13. Holder 13 is rigidly mounted on the washer 10, which in its turn is rigidly connected with adapter 2 via coupler 15. Thus, even when disconnected from the shaft 1, each rotor permanently continues to rotate with shaft, thereby providing inertial acceleration of shaft rotation and ensuring smooth operation of the engine.

Figure 5:
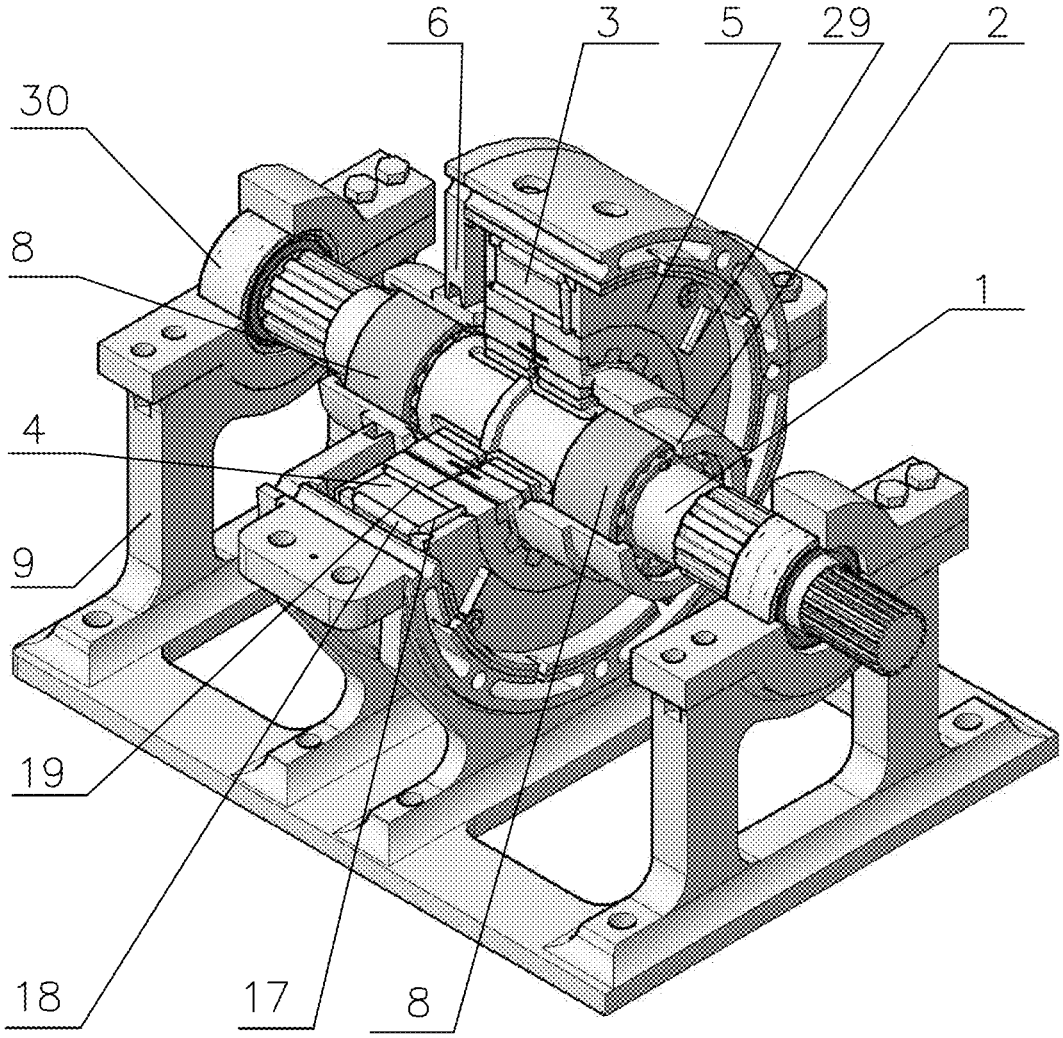
FIG. 5 is a perspective view of the assembled disclosed middle part of rotary vane internal combustion engine of the present invention.

FIG. 5 is a perspective view of the assembled disclosed middle part of rotary vane internal combustion engine of the present invention, with one of the cooling cavities open.

Figure 9:
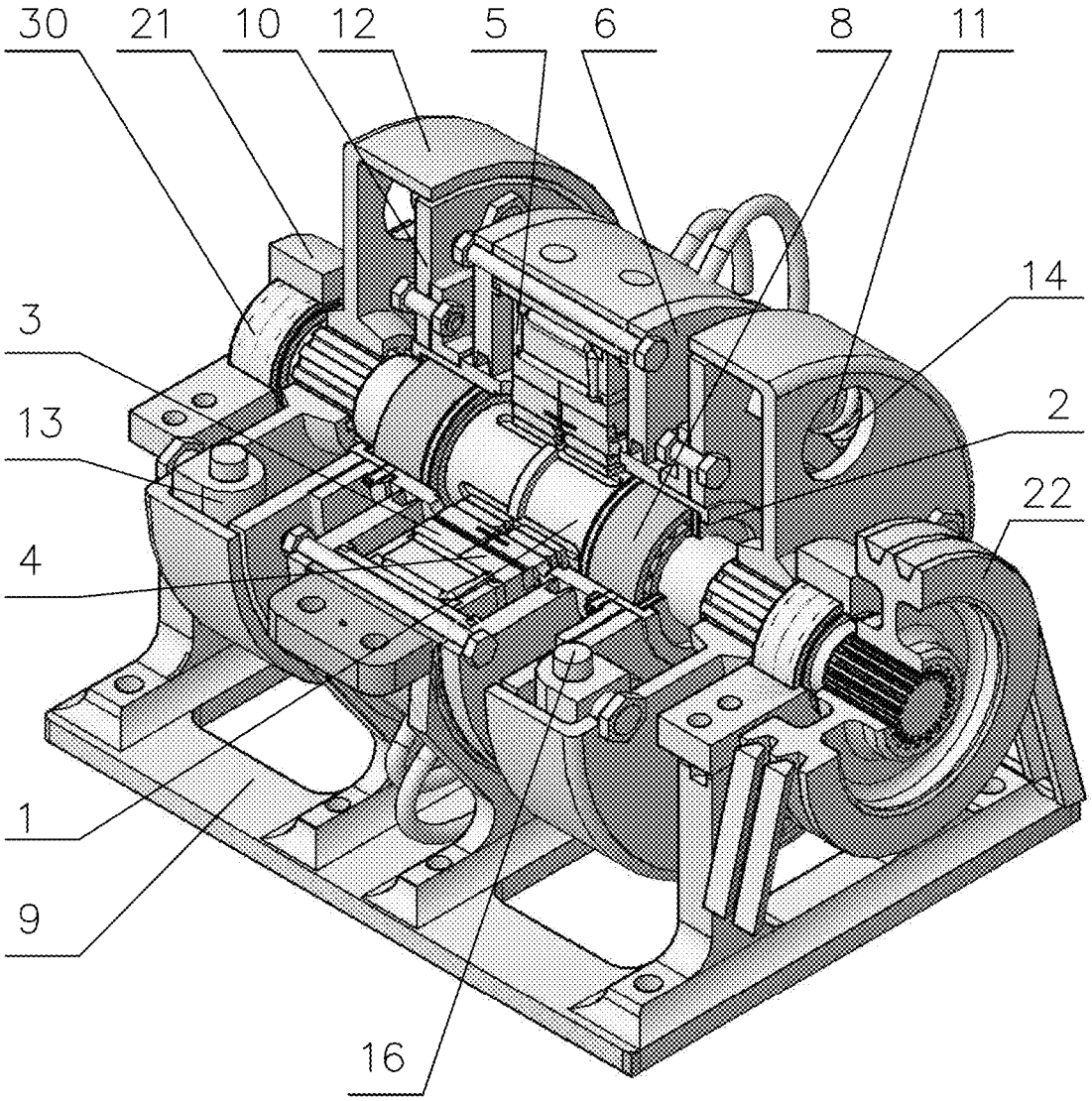
FIG. 9 is a perspective view of the assembled rotary vane internal combustion engine of the present invention.

FIG. 9 shows a perspective view of the assembled rotary vane internal combustion engine, where the shaft 1 installed on the bearings 30 and on the bearing shells 7 that provide reliable operation of the engine of the present invention. Transmission of engine torque from the drive shaft 1 is carried out through belt or gear connector 22.

Figure 10:
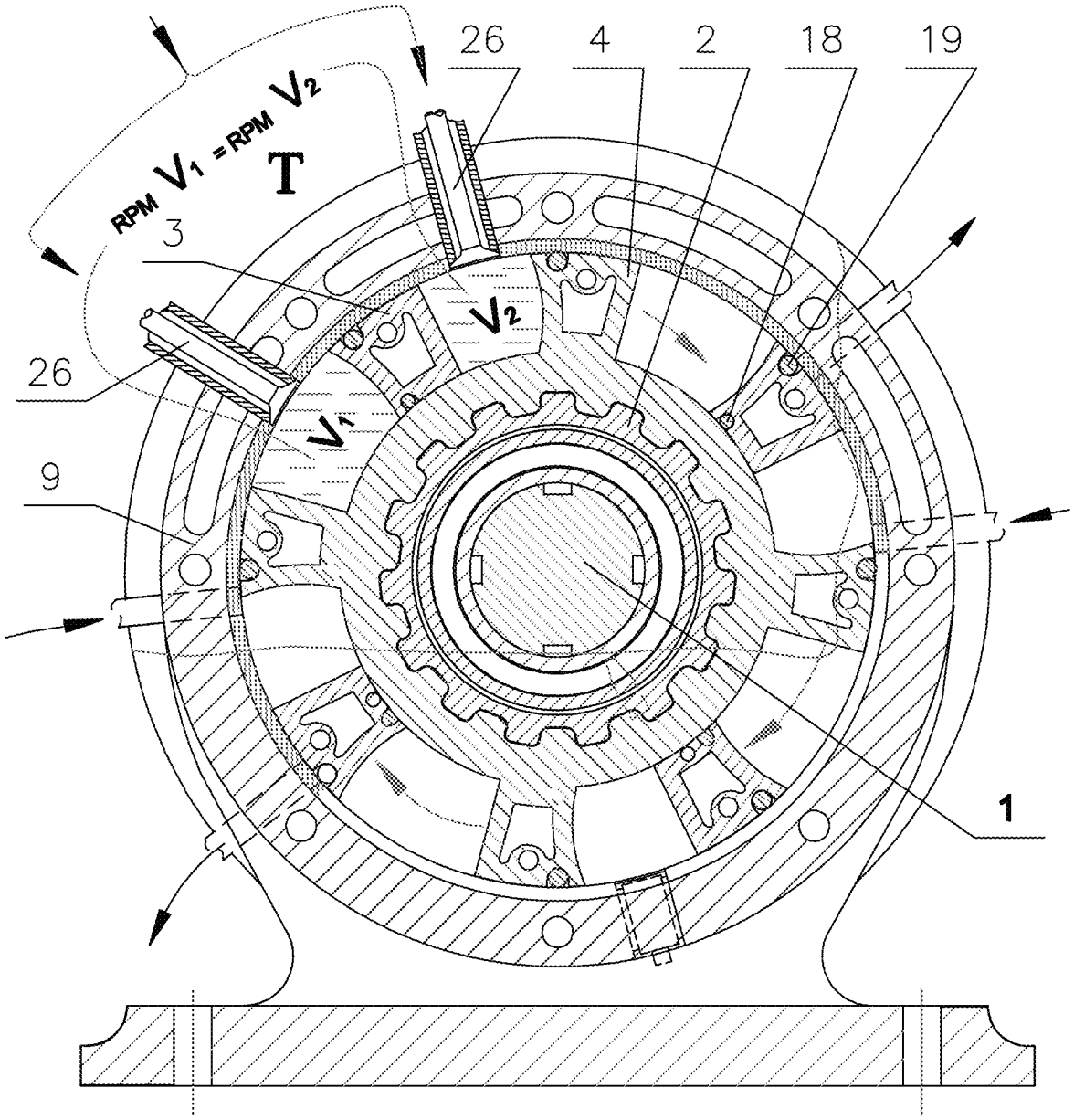
FIG. 10 is an engine starting schema with forcible fuel mixture injection of rotary vane internal combustion engine of the present invention.

FIG. 10 is an engine starting schema with forcible fuel-mixture injection of rotary vane internal combustion engine of the present invention.

Figure 11:
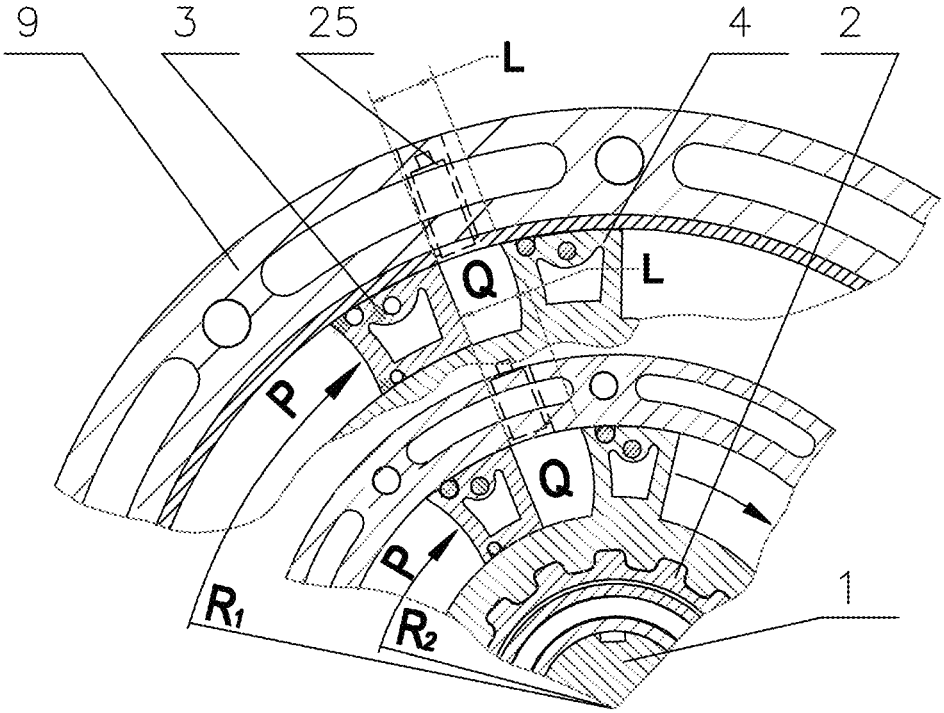
FIG. 11 is schematically illustrated multivariate relationship of chambers volume and torque, which optimize the efficiency of a rotary vane internal combustion engine of the present invention.

FIG. 11 shows schematically the optimization of the relationship between volume of chambers and torque of rotary vane internal combustion engine of the present invention. Design is made in such a manner that enables calculation of the optimal size of the radius R of force application P, for the planned volume of the chambers, given constant volume Q of chambers.

Figure 12A:
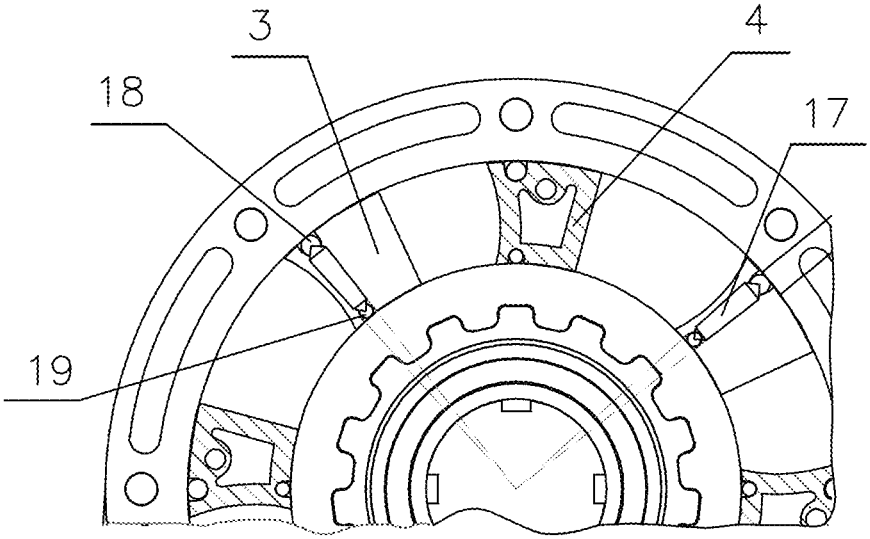
FIGS. 12A and 12B illustrate the section and perspective views, respectively, of the roller and conical seals of rotary vane internal combustion engine of the present invention.
Figure 12B:
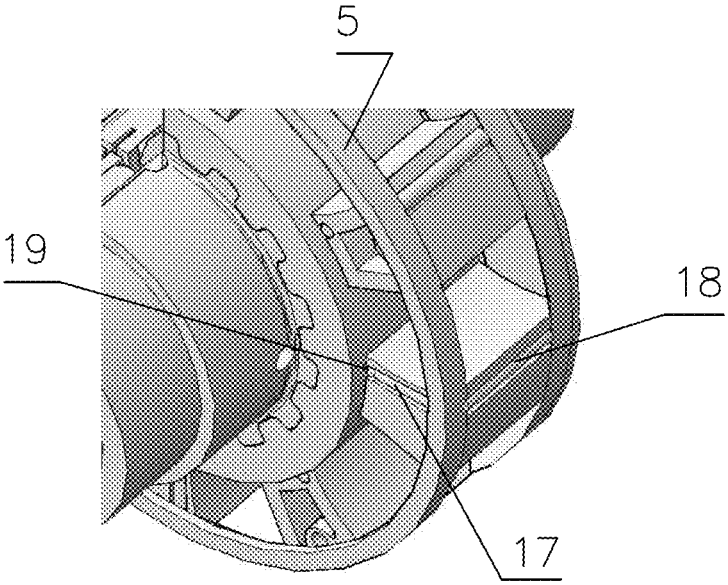

Drawing FIGS. 12A and 12B show a detailed cut-away D of FIG. 6 and show, respectively, section and perspective views of the roller 18 and 19 graphite seals, and conical 17 graphite seal of rotary vane internal combustion engine of the present invention.

OPERATION OF THE INVENTION

The present invention will now be explained in greater detail with the reference to operation of the embodiments, which are represented in the accompanying drawings.

Engine start is initiated by the forced injection of a fuel mixture using the inlet valves 26 (see FIG. 10), managed by pressure sensors. The fuel-mixture supply is carried out at the same time into the chambers at compression position C and combustion position S (i.e., chamber(s) aligned with the compression segment(s) and forming the compression compartment(s) C and chambers aligned with the ignition segment(s) and forming the ignition compartments (S)), at the same pressure. When pressure is sufficient, the pressure sensor gives command to start ignition by spark plug 25 in the chamber at position S (see FIG. 2). Delivery of the fuel mixture into the chambers at positions C and S by the inlet valves 26 occurs only at the moment (time) of engine start. Ignition in the chamber at position S is activated at a certain pressure in the system. Upon ignition, due to expansion of gas in the chamber at position S, the rotors begin move in different directions, with one of the rotors 3 (or 4) entering into gearing with shaft 1 for forward rotation, due to its corresponding one-way overrunning clutch 8. At the same time, the other rotor, e.g., 4, is stationary on the shaft due to its corresponding flywheel 12, which overtakes and picks up the other rotor released by the corresponding one-way overrunning clutch 8, and is being prevented from returnable rotation on the shaft, by the flywheel's damper 14, but because the flywheel is rigidly mounted on the rotating shaft 1, the flywheel forces the other rotor to also rotate in the forward rotation.

After forced fuel-mixture injection into two chambers at positions C and S, first start-up begins the combustion of the fuel mixture in a chamber at position S, where ignition of the fuel mixture occurs and where one rotor causes the shaft to rotate in forward rotation, thereby causing the next chamber, in position C, to move into position S (i.e., reconfiguring the ignition compartment to now include the next chamber) for igniting the next chamber. The movements of the two chambers are enough for engine to begin work in regular cycle: intake, compression, combustion, exhaust. This way, the shaft 1 is alternatively attaching to one of the rotors, 3 or 4, and free passing through the other rotor, alternately connecting with the one-way overrunning clutches 8.

In this way each rotor alternately engages with the shaft and continues to rotate forward, even when it is disengaged from the shaft, due to retention by a flywheel 12, as shown on FIGS. 1, 7, and 8. The flywheel assemblies include washer 10 and flywheel 12 body, where one of them, washer 10 is connecting with rotor; and the other, flywheel 12 body is connecting with shaft 1. Between them there is a damper 14, with one end mounted on the washer 10 and the other on the flywheel 12 body. Damper force is adjusted by means of the holder 11 so that the deceleration of movement is sufficient only to disconnect a rotor from.

One of the main points of the present invention is that while the whole system (rotors, shaft, and clutches, etc.) is rotating with high speed in one direction, but inside the system includes alternating movement of the rotors and other components, which has eliminated impact and loads, providing good reliability without using reciprocating movement mechanisms, such as crankshaft, rocker arm or others.

The two rotors are assembled so that they form at least four closed chambers. Pressure inside chambers has a positive effect on (reduces) friction between rotors 3 and 4 (zone Z, FIG. 6), which keeps them without contact. In order to provide better conditions for the engine to eliminate friction between surfaces, the cylindrical 18, 19 and conical ferrite seals 17 are applied, and to decrease the gap between seals, rings 20 and 21 are used.

The next major advantage of the present invention is that the design is carried out in such a manner that the whole system (rotors, shaft, and clutches, etc.) is cooled inside by the circulating lubricating coolant. This is made possible due to using the existing cavity between the rotor 3, 4 and the housing cap 6 as a built-in pump. It means that on each outer side of the assembled rotor, on flange 5, mounted the left/right blade 28/29, that provides circulation of the cooling fluid around rotors through housing and groove in the shaft. The coolant enters the engine from the coolant tank through hole a, distributed into cavity of the housing 9, between rotor and housing cap 6 of left side FIG. 6, passes through hole fin the adapter 2 and through groove e of the shaft 1, and enters into cavity of right side through hole d, then coolant returns into the tank through hole c. Thus, the engine can be readily cooled and lubricated, which means it is not susceptible to overheating. The presented design of the engine allows for working conditions of one-way overrunning clutches 8 that are separated from the heating zone by a cavity of cooling pump.

ADVANTAGES

Some of the main advantages of the invention are reliability, ease of manufacture and ease of maintenance, durability and high efficiency of the proposed rotary vane internal combustion engine, in which:

Reciprocating movement mechanisms are not used;

No need to synchronize the rotation of the rotors, since the rotors do not have a rigid connection with each other;

The engine is not subject to overheating, since the main working assembly of the rotors, closed by the side flanges, is located in the cooling bath.

The present invention eliminates the disadvantages of existing designs of rotary vane internal combustion engines by efficiently utilizing a system of alternately rotating vanes using one-way overrunning clutches and by efficiently utilizing the rotor-holding cushioning mechanism (damper) that provides continuous shall rotation, being in favorable environment, due to the efficient use of the cooling system.

The working chambers formed by the vanes are rigidly closed by flanges on both sides, which reduces the number of rubbing surfaces, and roller and conical seals are installed on the remaining rubbing surfaces, which ensure the engine runs without or with minimum lubrication.

In one embodiment, a simplified engine starts due to a single injection of a fuel mixture into two adjacent chambers at compression and combustion positions, respectively, using a high-pressure compressor, and, after two consecutive ignitions to start the engine, the engine continues to operate in normal Otto cycle.

The possibility of creating a wide range of engines in terms of power and fuel consumption is also expanded, which is due to the lack of a direct relationship between the volume of the chambers and the working diameter of the cylinder of a rotary vane internal combustion engine.

The present invention aims to increase efficiency up to 70%.

The invented engine is equivalent to an eight-piston engine when using two vanes on each rotor, at this time four working cycles are carried out in one revolution, or to a sixteen-piston engine when four vanes are used on each rotor, that is, in one revolution it implements eight working cycles.

The present invention of a rotary vane internal combustion engine can more effectively be used in drones, since it has small dimensions and weight, low noise due to the absence of any reciprocating movement mechanism, and has high efficiency and relatively high power with low fuel consumption, wherein that the invented engine is easy to manufacture and maintain, and is durable and reliable. This engine can also be effectively used for hybrid cars, sports cars, electric generators, and household appliances.

Rotary vane engines, the most promising of all currently used internal combustion engines. In serial industrial production, there is no working sample from this rather large family.

The main reason for the lack of a working prior art design for this engine type is that during rotation, due to the enormous inertial loads, the mechanisms used to coordinate the rotation of the rotors and the associated rotor vanes are quickly destroyed, and the difficulty of removing heat from the working zone is no less important.

The proposed design of the rotary vane internal combustion engine eliminates these drawbacks, which allows us to create a new type of rotary vane machines that are easy to manufacture, reliable and highly efficient.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Unless stated otherwise, terms such as "first" and "second" are used to arbitrarily distinguish between the elements such terms describe. Thus, these terms are not necessarily intended to indicate temporal or other prioritization of such elements.

Unless otherwise stated, conditional languages such as "can", "could", "will", "might", or "may" are understood within the context as used in general to convey that certain embodiments include, while other embodiments do not include, certain features and/or elements. Thus, such conditional languages are not generally intended to imply that features and/or elements are in any way required for one or more embodiments.

It will be understood by those within the art that, in general, terms used herein, are generally intended as "open" terms (e.g., the term "including" should be interpreted as "including but not limited to", the term "having," should be interpreted as "having at least", the term "includes" should be interpreted as "includes but is not limited to", etc.). The term "coupled" should be interpreted to include both direct and indirect coupling.

I claim:

1. A rotary vane internal combustion engine comprising:

a first flywheel assembly rigidly connected to a shaft and comprising a first damper;

a second flywheel assembly rigidly connected to the shaft and comprising a second damper;

a cylindrical housing;

a rotor assembly located in the cylindrical housing and comprising (a) a pair of side-by-side rotors, wherein a first rotor of the pair of side-by-side rotors includes at least two radial vanes, the at least two radial vanes of the first rotor extending over a second rotor of the pair of side-by-side rotors, and wherein the second rotor includes at least two radial vanes, the at least two radial vanes of the second rotor extending over the first rotor; and (b) a pair of side-flanges, wherein a first side-flange of the pair of side-flanges is rigidly attached to the second rotor and closes off at least a part of a first side of the rotor assembly and wherein a second side-flange of the pair of side-flanges is rigidly attached to the first rotor and closes off at least a part of a second side of the rotor assembly;

wherein the pair of side-by-side rotors and the pair of side-flanges form at least one set of four radially spaced chambers; and wherein the at least one set of four radially spaced chambers cooperates with the cylindrical housing to form a corresponding at least one set of four radially spaced engine-compartments; wherein each of the side-by-side rotors of the pair of side-by-side rotors alternately engages with the shaft by a corresponding one-way overrunning clutch of a pair of one-way overrunning clutches to rotate the shaft in a forward direction;

wherein, during engagement with the shaft by the first rotor, the second damper couples to the second rotor for a time period comprising a first momentary duration and a first subsequent duration, such that (i) during the first momentary duration the second damper counters a deceleration of a forward rotation of the second rotor and (ii) during the first subsequent duration the second flywheel assembly forces the second rotor to continue rotating in the forward direction; and wherein, during engagement with the shaft by the second rotor, the first damper couples to the first rotor for a time period comprising a second momentary duration and a second subsequent duration, such that (i) during the second momentary duration the first damper counters a deceleration of a forward rotation of the first rotor and (ii) during the second subsequent duration the first flywheel assembly forces the first rotor to continue rotating in the forward direction.

2. The rotary vane internal combustion engine of claim 1, wherein the first rotor and the second rotor are mechanically unsynchronized with each other during their respective rotations.

3. The rotary vane internal combustion engine of claim 1, wherein the first side-flange is rigidly attached to the second rotor via the at least two radial vanes of the second rotor, and wherein the second side-flange is rigidly attached to the first rotor via the at least two radial vanes of the first rotor.

4. The rotary vane internal combustion engine of claim 1, further comprising a first cylindrical seal positioned between each of an upper surface of each respective radial vane of the at least two radial vanes of the first rotor and an upper surface of each respective radial vane of the at least two radial vanes of the second rotor, and an inner surface of the cylindrical housing;

a second cylindrical seal positioned between a lower surface of each respective radial vane of the at least two radial vanes of the first rotor and a radial surface of the second rotor;

a third cylindrical seal positioned between a lower surface of each respective radial vane of the at least two radial vanes of the second rotor and a radial surface of the first rotor;

a first conical seal positioned between each of a first side surface of each respective radial vane of the at least two radial vanes of the first rotor and a first side surface of each respective radial vane of the at least two radial vanes of the second rotor, and an inner surface of the first flange; and a second conical seal positioned between each of a second side surface of each respective radial vane; of the at least two radial vanes of the first rotor and a second side surface of each respective radial vane of the at least two radial vanes of the second rotor, and an inner surface of the second flange.

5. The rotary vane internal combustion engine of claim 4, wherein at least one of the first cylindrical seal, the second cylindrical seal, the third cylindrical seal, the first conical seal, and the second conical seal comprises a low-friction material.

6. The rotary vane internal combustion engine of claim 1, wherein the cylindrical housing comprises at least one set of four radially distributed segments comprising an ignition segment (Ss), a compression segment (Cs), an intake segment (Is), and an exhaust segment (Es);

wherein the intake segment includes a fuel-mixture supply port; wherein the exhaust segment includes a gas-exhaust port;

wherein the ignition segment is coupled to a first fuel-mixture inlet valve, the ignition segment comprises a spark plug for igniting a fuel mixture in an engine-chamber having the ignition segment;

wherein the compression segment is coupled to a second fuel-mixture inlet valve;

wherein, during an engine start operation, the first fuel-mixture inlet valve and the second fuel-mixture inlet valves are configured to inject the fuel mixture into a pair of chambers that are aligned with the ignition segment and the compression segment, respectively.

7. The rotary vane internal combustion engine of claim 1, wherein the first damper counters the deceleration of the forward rotation of the first rotor by absorbing a deceleration energy of the first rotor, and the second damper counters the deceleration of the forward rotation of the second rotor by absorbing a deceleration energy of the second rotor.

8. The rotary vane internal combustion engine of claim 7, wherein, during the first subsequent duration, the second damper uses at least a portion of the absorbed deceleration energy of the second rotor to accelerate rotation of the second rotor in the forward direction; and wherein, during the second subsequent duration, the first damper uses at least a portion of the absorbed deceleration energy of the first rotor to accelerate rotation of the first rotor in the forward direction.

9. The rotary vane internal combustion engine of claim 1, wherein an energy-absorption characteristic of each of the first damper and the second damper is adjustable.

10. The rotary vane internal combustion engine of claim 1, wherein the first damper comprises a first spring, and the second damper comprises a second spring.

11. The rotary vane internal combustion engine of claim 1, wherein each of the one-way overrunning clutches is selected from a set comprising a ball clutch, a roller clutch, and a magnetic clutch.

12. The rotary vane internal combustion engine of claim 1, further comprising a first adapter coupling the first rotor to (i) the one-way overrunning clutch engaging with the first rotor and (ii) the first flywheel assembly; and a second adapter coupling the second rotor to (i) the one-way overrunning clutch engaging with the second rotor and (ii) the second flywheel assembly.

* * * * *